US012369719B2

(12) United States Patent
Zhou et al.

(10) Patent No.: US 12,369,719 B2
(45) Date of Patent: Jul. 29, 2025

(54) BED FRAME AND INSTALLATION METHOD THEREOF

(71) Applicant: Aukey Technology Co., Ltd, Shenzhen (CN)

(72) Inventors: Feng Zhou, Shenzhen (CN); Riqiang Qin, Shenzhen (CN)

(73) Assignee: Aukey Technology Co., Ltd, Shenzhen (CN)

( * ) Notice: Subject to any disclaimer, the term of this patent is extended or adjusted under 35 U.S.C. 154(b) by 280 days.

(21) Appl. No.: 18/319,547

(22) Filed: May 18, 2023

(65) Prior Publication Data

US 2024/0349900 A1 Oct. 24, 2024

(30) Foreign Application Priority Data

Apr. 24, 2023 (CN) ..... 202321006277.6

(51) Int. Cl.
*A47C 19/02* (2006.01)
*A47C 19/00* (2006.01)

(52) U.S. Cl.
CPC ..... *A47C 19/021* (2013.01); *A47C 19/005* (2013.01)

(58) Field of Classification Search
CPC ... A47C 19/021; A47C 19/005; A47C 19/025; A47C 19/027; F16B 12/54; F16B 12/32; F16B 7/0413; F16B 9/056; F16B 37/043; F16B 12/56
See application file for complete search history.

(56) References Cited

U.S. PATENT DOCUMENTS

| | | | | |
|---|---|---|---|---|
| 2,656,577 | A * | 10/1953 | Carbary | F16B 9/056 24/581.1 |
| 11,457,747 | B2 * | 10/2022 | Hong | F16B 12/54 |
| 2003/0074737 | A1 * | 4/2003 | Leng | A47C 19/025 5/659 |
| 2011/0243685 | A1 * | 10/2011 | Mazur | F16B 37/043 411/103 |
| 2018/0344040 | A1 * | 12/2018 | Lee | A47C 19/024 |
| 2018/0372138 | A1 * | 12/2018 | Li | A47C 19/20 |
| 2019/0186524 | A1 * | 6/2019 | Roy | F16B 37/044 |
| 2020/0315360 | A1 * | 10/2020 | Yang | A47C 19/024 |
| 2020/0345148 | A1 * | 11/2020 | Qiu | A47C 19/005 |
| 2020/0375367 | A1 * | 12/2020 | Qiu | A47C 19/005 |
| 2022/0213913 | A1 * | 7/2022 | Choi | A47C 19/021 |
| 2023/0355001 | A1 * | 11/2023 | Lei | A47C 19/025 |
| 2024/0074590 | A1 * | 3/2024 | Werner | A47C 19/025 |

* cited by examiner

*Primary Examiner* — Justin C Mikowski
*Assistant Examiner* — Alison N Labarge
(74) *Attorney, Agent, or Firm* — IPRO, PLLC

(57) ABSTRACT

A bed frame comprises one or more bed frame modules, each bed frame module comprises two metal brackets longitudinally arranged, a plurality of bed board strips and a non-rigid gap locking piece, each metal bracket is provided with inner side plates arranged oppositely, each inner side plate is provided with a plurality of slots at intervals; each bed board strip comprises a main body and metal mounting parts with bayonets at two ends of the main body; the metal mounting parts are fastened into the slots; the non-rigid gap locking piece comprises a limit plate with a limit notch and a first buckle extending from an inner surface of the limit plate; the first buckle passes through the slot to be clamped with an inner surface of the metal bracket, two inner side walls of the limit notch respectively abut against two side walls of the metal mounting part.

14 Claims, 12 Drawing Sheets

BED FRAME AND INSTALLATION METHOD THEREOF

CROSS-REFERENCE TO RELATED APPLICATIONS

This application is based upon and claims priority to Chinese Patent Application No. 202321006277.6, filed before China National Intellectual Property Administration on Apr. 24, 2023 and entitled "BED FRAME AND INSTALLATION METHOD THEREOF," the entire contents of which are incorporated herein by reference.

TECHNICAL FIELD

Embodiments of the present application relate to the technical field of furniture, and in particular, relate to a bed frame and an installation method thereof.

BACKGROUND

A metal bed frame is generally composed of two metal brackets longitudinally arranged and a plurality of bed board strips, a plurality of slots are opened at intervals on inner side plates of the two metal brackets, metal mounting parts are provided at both ends of each of the bed board strips, and thus the installation between the bed board strips and the metal brackets can be realized simply by inserting the metal mounting parts at both ends of the bed board strip into the slots of the two metal brackets respectively.

In the process of implementing the present application, the inventor of the present application found that: in order to make the metal mounting part be inserted into the slot smoothly, generally there is a gap between the metal mounting part and the inner wall of the slot, and the bed frame will be driven to shake when the user lies down, gets up or turns over; at this point, the metal mounting part is likely to collide or rub the inner wall of the slot to generate a sound of metal collision, which results in bad experience for the user.

SUMMARY

The technical problem mainly to be solved by the embodiments of the present application is to provide a bed frame and an installation method thereof, which can reduce the risk of generating noise by the bed frame due to the collision between the metal bracket and the bed board strip when the bed frame swings.

In order to solve the above technical problem, a technical solution adopted by the present application is to provide a bed frame which comprises two metal brackets longitudinally arranged, a plurality of bed board strips and a non-rigid gap locking piece, each of the metal brackets being provided with inner side plates arranged oppositely, each of the inner side plates being provided with a plurality of slots at intervals; each of the bed board strips comprising a main body and metal mounting parts at two ends of the main body, the metal mounting parts being provided with bayonets; wherein the metal mounting parts are fastened into the slots; the non-rigid gap locking piece comprises a limit plate and a first buckle obtained by extending from an inner surface of the limit plate, the limit plate being provided with a limit notch; wherein the first buckle passes through the slot to be clamped with an inner surface of the metal bracket, two inner side walls of the limit notch respectively abut against two side walls of the metal mounting part to prevent the two side walls of the metal mounting part from contacting with two inner side walls of the slot.

Preferably, an inner top wall of the limit notch abuts against a top wall of the metal mounting part.

Preferably, the top of the first buckle abuts against an inner top wall of the slot to restrict the movement of the metal mounting part along the direction of the slot.

Preferably, the metal bracket is a hollow metal tube structure.

Preferably, the main body and the metal mounting part of the bed board strip are an integrally formed metal tube structure, and the metal mounting part is a flat structure formed at the end of the bed board strip.

In order to solve the above technical problem, another technical solution adopted by the present application is to provide a bed frame, which comprises two metal brackets longitudinally arranged, a plurality of bed board strips and a non-rigid gap locking piece, each of the metal brackets being provided with inner side plates arranged oppositely, each of the inner side plates being provided with a plurality of slots at intervals; the non-rigid gap locking piece comprises an upper limit plate, a lower limit plate and a first deformation plate, wherein a first buckle is formed by extending from an inner surface of the upper limit plate, the first buckle passes through the slot to be clamped with an inner surface of the metal bracket, a second buckle is formed by extending from an inner surface of the lower limit plate, the second buckle passes through the slot to be clamped with the inner surface of the metal bracket and abut against an inner bottom wall of the slot, the first deformation plate is arranged between the upper limit plate and the lower limit plate, the first deformation plate is provided with a limit opening; wherein when both the upper limit plate and the lower limit plate are clamped with the metal bracket, the first deformation plate is in a bent and deformed state; each of the bed board strips comprises a main body and metal mounting parts at two ends of the main body, the metal mounting parts are provided with bayonets; wherein the metal mounting part passes through the limit opening and the slot in turn and is detachably fastened on the inner side plate; wherein two inner side walls of the limit opening respectively abut against two side walls of the metal mounting part, and an inner bottom wall of the limit opening abuts against an inner top wall of the bayonet of the metal mounting part to prevent the bottom of the metal mounting part from contacting with the inner bottom wall of the slot, and prevent the two side walls of the metal mounting part from contacting with the inner bottom wall and two inner side walls of the slot respectively.

Preferably, an inner top wall of the limit opening abuts against a top wall of the metal mounting part.

Preferably, the top of the first buckle abuts against an inner top wall of the slot to restrict the movement of the metal mounting part along the direction of the slot.

Preferably, the second buckle is formed with a first limit groove, one inner side wall of the bayonet faces a bottom surface of the first limit groove, and another inner side wall of the bayonet faces the lower limit plate.

Preferably, bending marks are formed respectively at joints between the first deformation plate and the upper limit plate as well as between the first deformation plate and the lower limit plate, and at least one bending mark is formed at the middle of the first deformation plate.

In order to solve the above technical problem, yet another technical solution adopted by the present application is to provide a bed frame which comprises two metal brackets longitudinally arranged, a plurality of bed board strips and a non-rigid gap locking piece, each of the metal brackets being provided with inner side plates arranged oppositely, each of the inner side plates being provided with a plurality of slots at intervals; the non-rigid gap locking piece comprises an upper limit plate, a lower limit plate and a bending part formed between the upper limit plate and the lower limit plate; wherein the lower limit plate is provided with an opening, a second buckle is formed by extending from an inner surface of the lower limit plate, the second buckle passes through the slot to be clamped with an inner surface of the metal bracket and abut against an inner bottom wall of the slot; an edge of the upper limit plate far away from the bending part is provided with a limit notch, and a third buckle is formed by extending from an outer surface of the upper limit plate, the third buckle passes through the opening and the slot in turn to be clamped on the inner surface of the metal bracket; each of the bed board strips comprises a main body and metal mounting parts at two ends of the main body, the metal mounting parts are provided with bayonets; wherein the metal mounting parts pass through the opening and the slot in turn and are detachably fastened on the inner side plate; wherein two inner side walls of the opening respectively abut against two side walls of the metal mounting part, and an inner bottom wall of the opening abuts against an inner top wall of the bayonet of the metal mounting part, so as to prevent the bottom of the metal mounting part from contacting with the inner bottom wall of the slot, and prevent the two side walls of the metal mounting part from contacting with two inner side walls of the slot respectively.

Preferably, an inner top wall of the limit notch abuts against a top wall of the metal mounting part.

Preferably, the top of the first buckle abuts against an inner top wall of the slot to restrict the movement of the metal mounting part along the direction of the slot.

Preferably, a first buckle is formed by extending from the inner surface of the lower limit plate, and the first buckle passes through the slot to be clamped with the inner surface of the metal bracket.

In order to solve the above technical problem, a further technical solution adopted by the present application is to provide a method for installing a bed frame, the bed frame comprises one or more bed frame modules, and each of the bed frame modules comprises two metal brackets longitudinally arranged, a plurality of bed board strips and a non-rigid gap locking piece, each of the metal brackets is provided with inner side plates arranged oppositely, each of the inner side plates is provided with a plurality of slots at intervals; each of the bed board strips comprises a main body and metal mounting parts at two ends of the main body, the metal mounting parts are provided with bayonets; the non-rigid gap locking piece comprises a limit plate and a first buckle obtained by extending from an inner surface of the limit plate, the limit plate is provided with a limit notch;

the method comprises the following steps:

inserting the metal mounting part into the inner side plate and moving the metal mounting part downwards along the bayonet to realize interlocking and fastening with the inner side plate;

riding the limit notch of the limit plate on a top wall of the metal mounting part;

passing the first buckle through the slot to be clamped with an inner surface of the metal bracket, so that two inner side walls of the limit notch respectively abut against two side walls of the metal mounting part, so as to prevent the two side walls of the metal mounting part from contacting with two inner side walls of the slot.

In order to solve the above technical problem, one technical solution adopted by the present application is to further provide a method for installing a bed frame, the bed frame comprises one or more bed frame modules, each of the bed frame modules comprises two metal brackets longitudinally arranged, a plurality of bed board strips and a non-rigid gap locking piece, each of the metal brackets is provided with inner side plates arranged oppositely, each of the inner side plates is provided with a plurality of slots at intervals; the non-rigid gap locking piece comprises an upper limit plate, a lower limit plate and a first deformation plate, a first buckle is formed by extending from an inner surface of the upper limit plate, a second buckle is formed by extending from an inner surface of the lower limit plate, the first deformation plate is formed between the upper limit plate and the lower limit plate, the first deformation plate is provided with a limit opening; each of the bed board strips comprises a main body and metal mounting parts at two ends of the main body, the metal mounting parts are provided with bayonets;

the method comprises the following steps:

operating the lower limit plate, and passing the second buckle through the slot to be clamped with an inner surface of the metal bracket and abut against an inner bottom wall of the slot;

inserting the metal mounting part into the inner side plate through the limit opening and the slot in turn, and moving the metal mounting part downwards along the bayonet to realize interlocking and fastening with the inner side plate;

pressing the upper limit plate downwards so that the first deformation plate is in a bent and deformed state, and passing the first buckle through the slot to be clamped with the inner surface of the metal bracket, so that two inner side walls of the limit opening respectively abut against two side walls of the metal mounting part, and an inner bottom wall of the limit opening abuts against an inner top wall of the bayonet of the metal mounting part, so as to prevent the bottom of the metal mounting part from contacting with the inner bottom wall of the slot, and prevent the two side walls of the metal mounting part from contacting with two inner side walls of the slot respectively.

In order to solve the above technical problem, one technical solution adopted by the present application is to provide a method for installing a bed frame, the bed frame comprises one or more bed frame modules, each of the bed frame modules comprises two metal brackets longitudinally arranged, a plurality of bed board strips and a non-rigid gap locking piece, each of the metal brackets is provided with inner side plates arranged oppositely, each of the inner side plates is provided with a plurality of slots at intervals; the non-rigid gap locking piece comprises an upper limit plate, a lower limit plate and a bending part formed between the upper limit plate and the lower limit plate; wherein the lower limit plate is provided with an opening, a second buckle is formed by extending from an inner surface of the lower limit plate, an edge of the upper limit plate far away from the bending part is provided with a limit notch, a third buckle is formed by extending from an outer surface of the upper limit plate; each of the bed board strips comprises a main body and metal mounting parts at two ends of the main body, the metal mounting parts are provided with bayonets;

the method comprises the following steps:

operating the lower limit plate, and passing the second buckle through the slot to be clamped with an inner surface of the metal bracket and abut against an inner bottom wall of the slot;

inserting the metal mounting part into the inner side plate through the opening and the slot in turn, and moving the metal mounting part downwards along the bayonet to realize interlocking and fastening with the inner side plate, so that two inner side walls of the opening respectively abut against two side walls of the metal mounting part, and an inner bottom wall of the opening abuts against an inner top wall of the bayonet of the metal mounting part, so as to prevent the bottom of the metal mounting part from contacting with the inner bottom wall of the slot, and prevent the two side walls of the metal mounting part from contacting with two inner side walls of the slot respectively;

rotating the upper limit plate, and passing the third buckle through the opening and the slot in turn to be clamped with the inner surface of the metal bracket, so that an inner top wall of the limit notch abuts against a top wall of the metal mounting part.

Beneficial effects of the embodiments of the present application are as follows: different from the situation in the prior art, in the embodiments of the present application, a plurality of slots distributed at intervals are arranged on the metal bracket, a first buckle extends from the limit plate, and a limit notch is provided at the limit plate, the first buckle is clamped on the inner surface of the metal bracket from the slot, and the two inner side walls of the limit notch respectively abut against the two side walls of the metal mounting part, thereby preventing the two side walls of the metal mounting part from contacting with the two inner side walls of the slots; and this is beneficial for reducing the collision or friction between the metal bracket and the bed board strip caused by the swing of the bed frame, and reducing the noise generated by the bed frame.

BRIEF DESCRIPTION OF THE DRAWINGS

In order to explain the technical solutions of the embodiments of the present application more clearly, attached drawings needed to be used in the embodiments of the present application will be briefly introduced hereinafter; obviously, the attached drawings described below are only some embodiments of the present application, and other attached drawings can also be obtained by those of ordinary skill in the art according to the attached drawings without creative labor.

DETAILED DESCRIPTION

Figure 1:
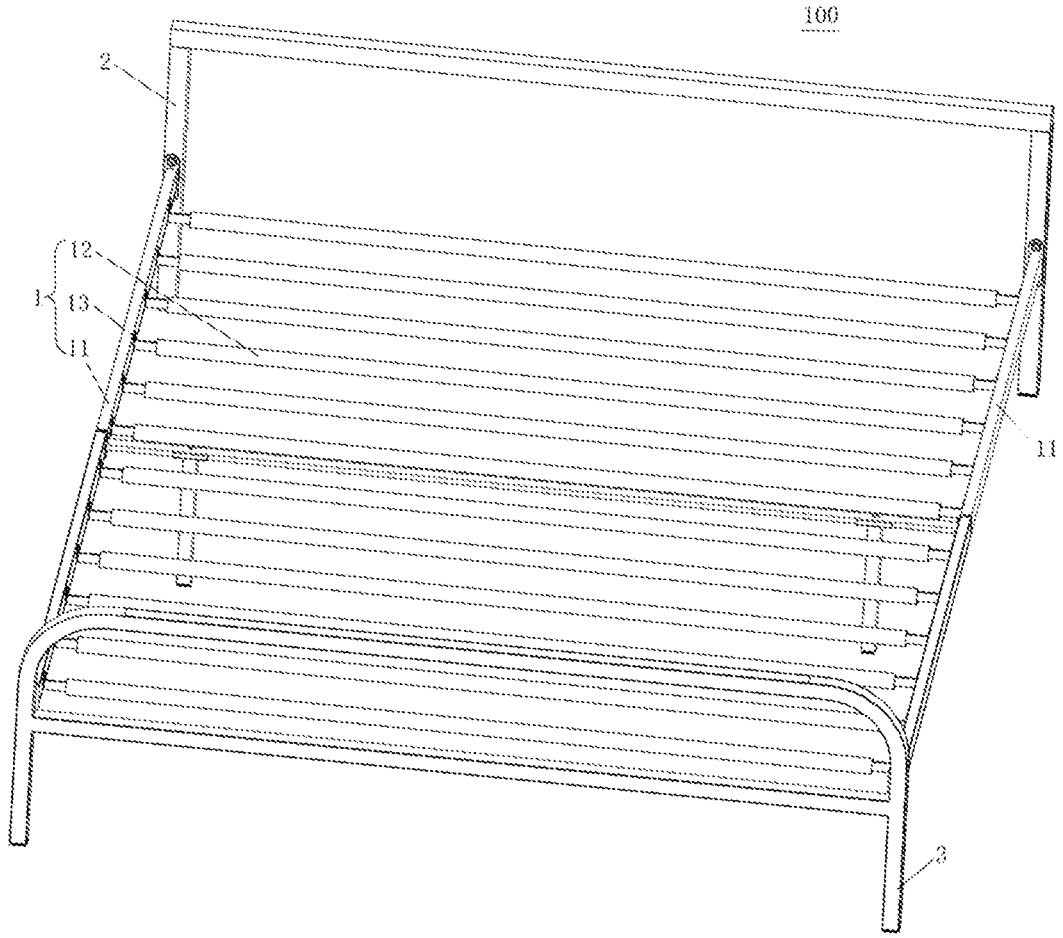
FIG. 1 is a schematic structural diagram of a bed frame provided according to an embodiment of the present application.
Figure 2:
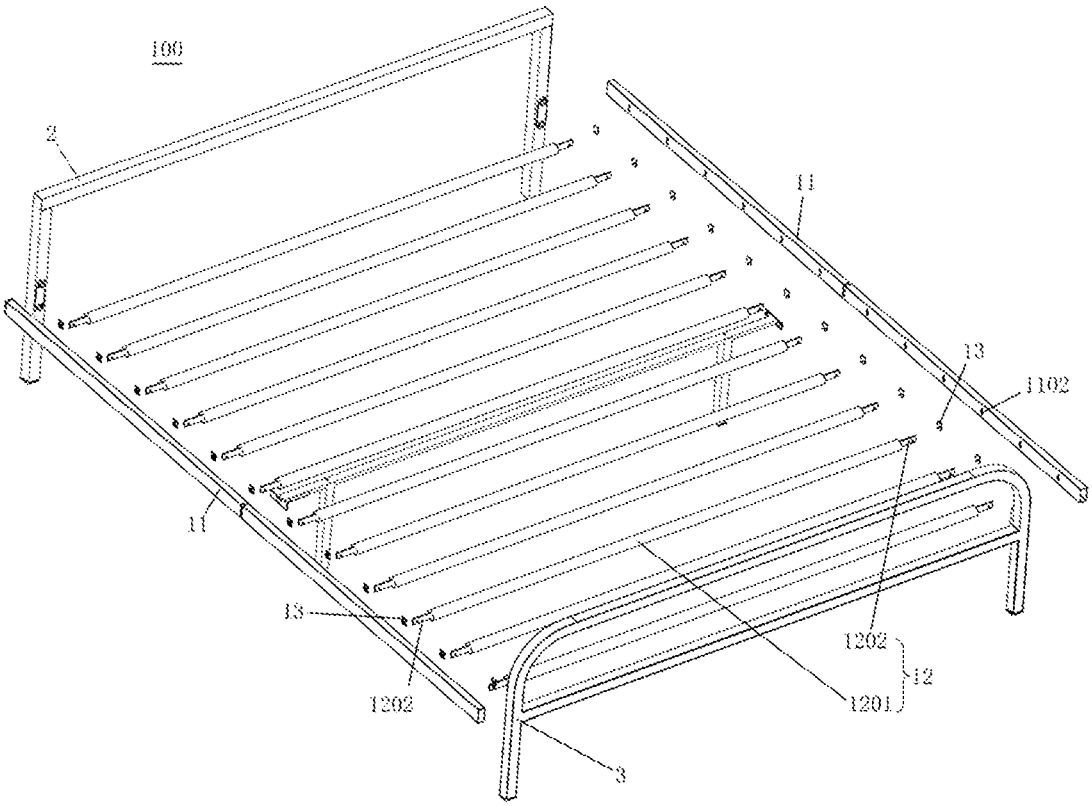
FIG. 2 is a schematic view of the exploded state of the bed frame provided according to the embodiment of the present application.
Figure 3:
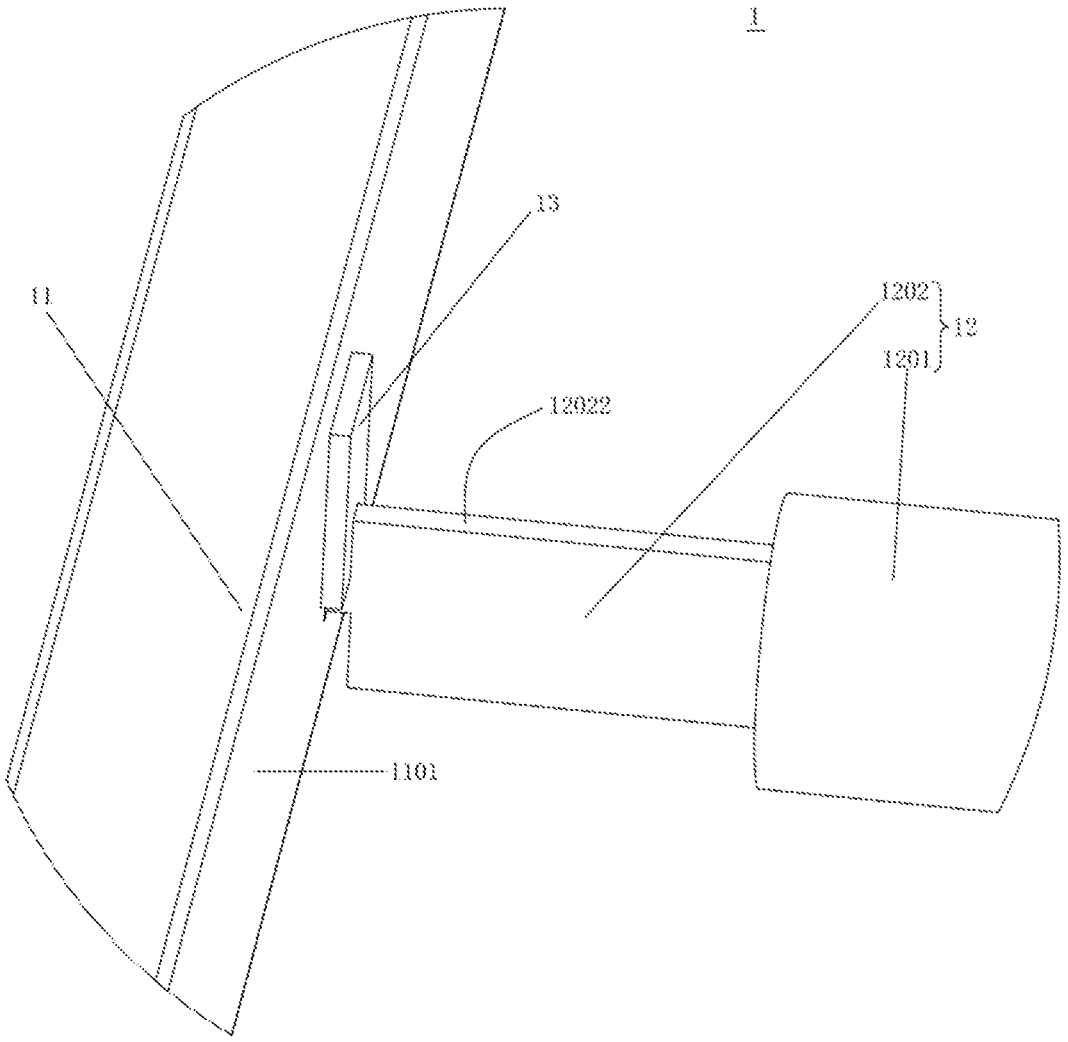
FIG. 3 is a schematic view of a partial structure of a bed frame module in a first embodiment of the present application.
Figure 4:
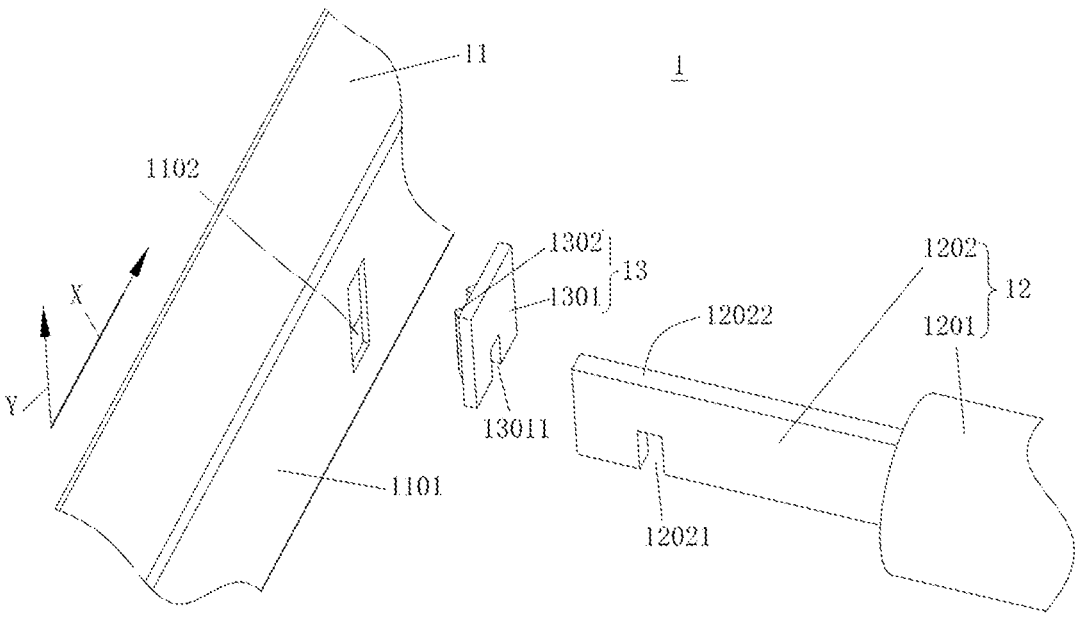
FIG. 4 is a schematic view of the exploded state of the partial structure of the bed frame module in the first embodiment of the present application.
Figure 5:
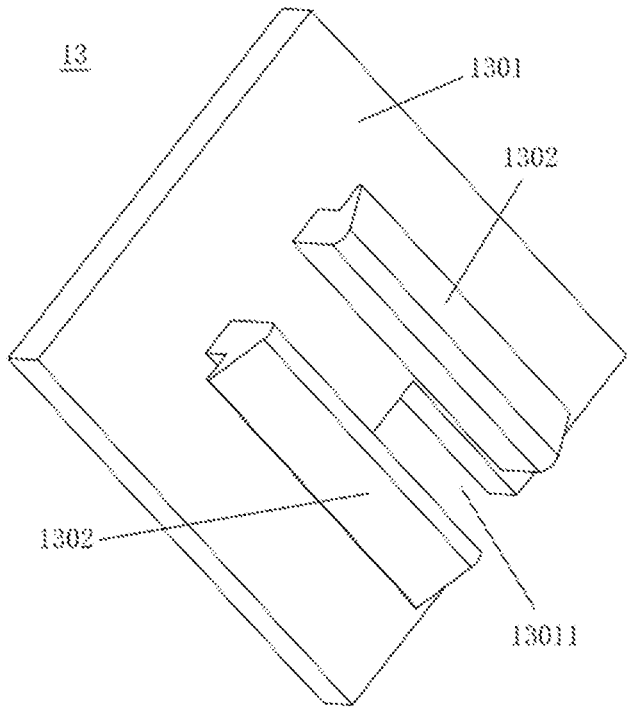
FIG. 5 is a schematic structural diagram of a non-rigid gap locking piece in the first embodiment of the present application.
Figure 6:
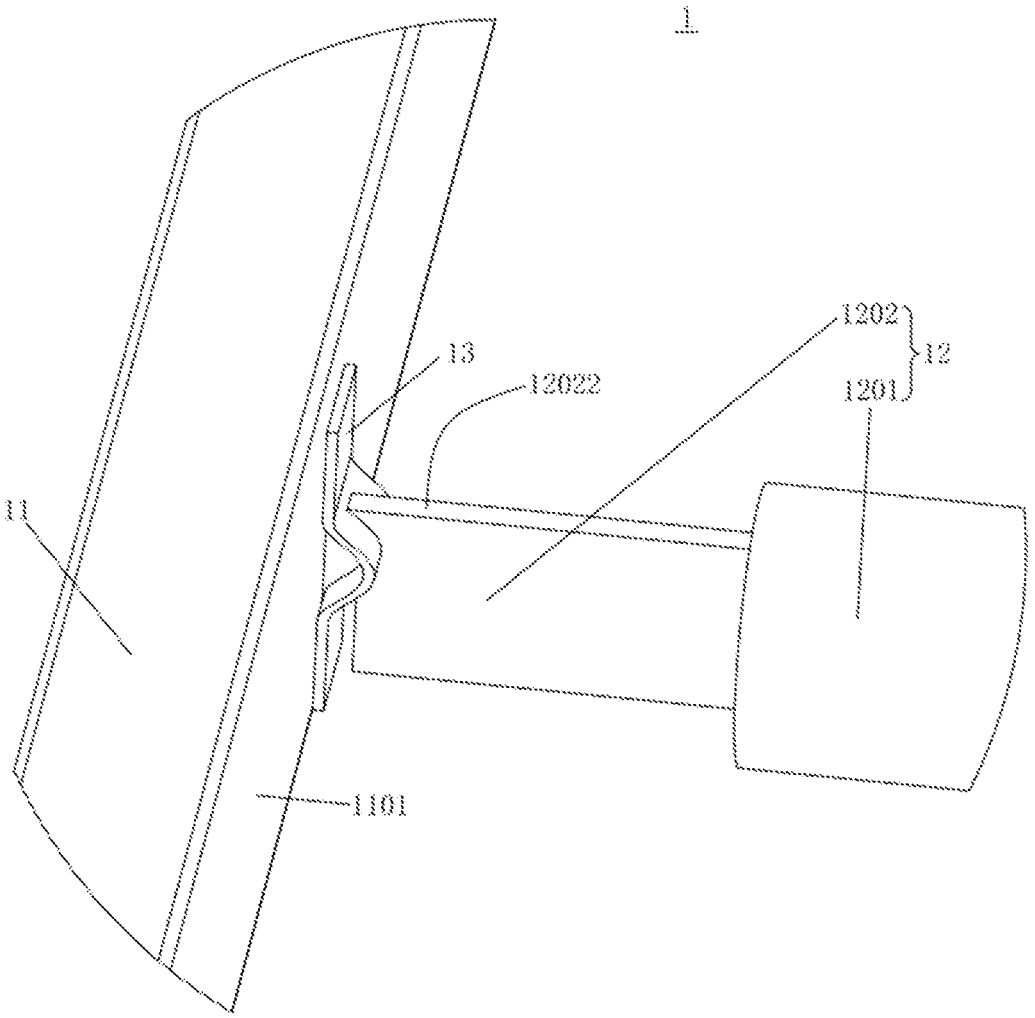
FIG. 6 is a schematic view of a partial structure of a bed frame module in a second embodiment of the present application.
Figure 7:
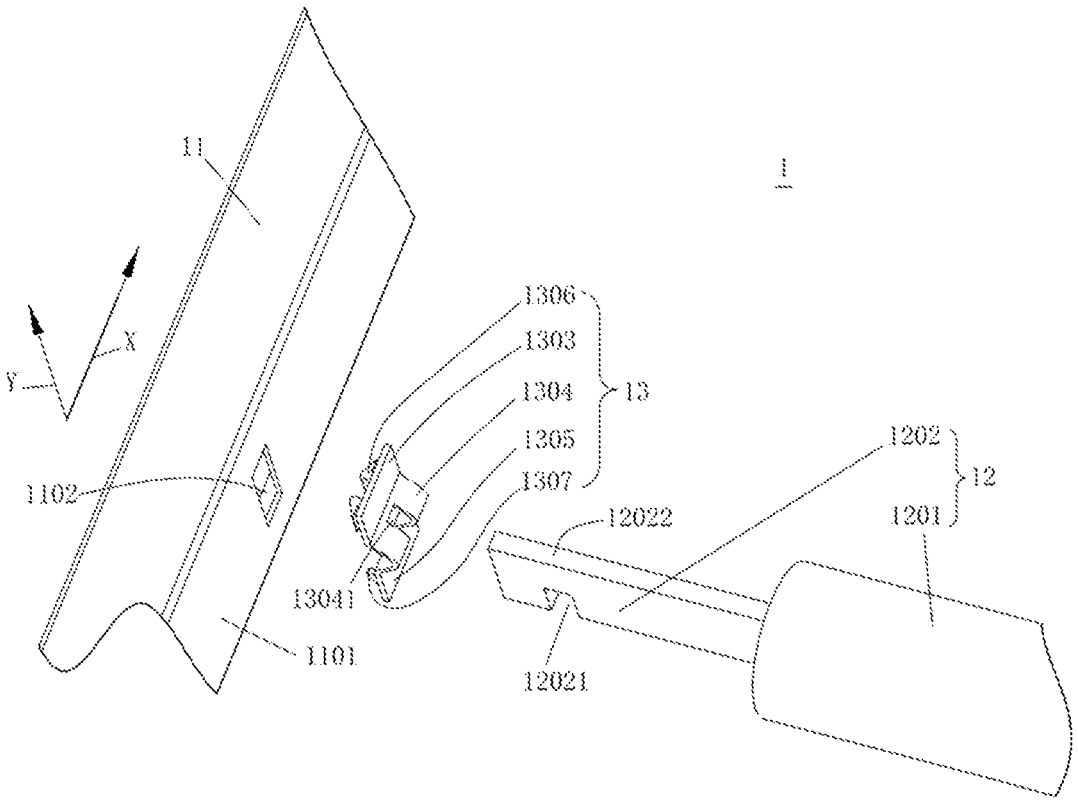
FIG. 7 is a schematic view of the exploded state of the partial structure of the bed frame module in the second embodiment of the present application.

In order to facilitate the understanding of the present application, the present application will be described in more detail in combination with the attached drawings and specific embodiments. It shall be noted that, when an element is expressed to be "fixed to" another element, it may be directly on the other element, or there may be one or more intervening elements therebetween. When an element is expressed to be "connected" to another element, it may be directly connected to another element, or there may be one or more intervening elements therebetween. Terms such as "vertical", "horizontal", "left" and "right" and similar expressions used in this specification are used for illustrative purposes only.

Unless otherwise defined, all technical and scientific terms used in this specification have the same meaning as those commonly understood by those skilled in the art of the present application. The terms used in this specification of the present application are only for the purpose of describing specific embodiments, and are not used to limit the present application. The term "and/or" used in this specification includes any and all combinations of one or more associated items listed.

First Embodiment

Referring to FIG. 1 to FIG. 5, a bed frame 100 comprises one or more bed frame modules 1, a bed head support frame 2 and a bed tail support frame 3, each of the bed frame modules 1 comprises two metal brackets 11 longitudinally arranged, a plurality of bed board strips 12 and a plurality of non-rigid gap locking pieces 13. Two ends of one metal bracket 11 are respectively installed at one side of the bed head support frame 2 and one side of the bed tail support frame 3, and two ends of the other metal bracket 11 are respectively installed at the other side of the bed head support frame 2 and the other side of the bed tail support frame 3; the bed head support frame 2 and the bed tail support frame 3 are jointly used for supporting the metal brackets 11, and the two metal brackets 11 are parallel to each other. One end of a bed board strip 12 is mounted on one of the metal brackets 11, and the other end of a bed board strip 12 is mounted on another metal bracket 11, one end of a bed board strip 12 is mounted on a metal bracket 11 through a non-rigid gap locking piece 13, the non-rigid gap locking piece 13 is used to limit the displacement of the bed board strip 12 and reduce the rigid contact between the bed board strip 12 and the metal bracket 11, thereby reducing the collision between the metal bracket 11 and the bed board strip 12 caused by the swing of the bed frame 100, and thus reducing the risk of generating noise by the bed frame 100.

For the above-mentioned metal brackets 11, each of the metal brackets 11 has an inner side plate 1101, and the inner side plates 1101 of the two metal brackets 11 are arranged oppositely; specifically, the inner side plate 1101 of one metal bracket 11 is located on one side of the metal bracket 11 facing the other metal bracket 11, and the inner side plate 1101 of the other metal bracket 11 is located on one side of the other metal bracket 11 facing the metal bracket 11. The inner side plate 1101 of each metal bracket 11 is provided with a plurality of slots 1102 at intervals, and the plurality of slots 1102 on the two inner side plates 1101 are in one-to-one correspondence; specifically, one end of a bed board strip 12 is installed in a slot 1102 in an inner side plate 1101, and the other end of a bed board strip 12 is installed in the corresponding slot 1102 in the other inner side plate 1101, so that the plurality of bed board strips 12 are distributed at intervals between the two metal brackets 11 along the length direction of the metal brackets 11. It is worth noting that the number of non-rigid gap locking pieces 13 is twice as much as the number of the bed board strips 12, one non-rigid gap locking piece 13 is clamped in a slot 1102, and each of two ends of the plurality of bed board strips 12 is respectively installed on the inner side plate 1101 through a non-rigid gap locking piece 13.

For the above-mentioned bed board strip 12, the bed board strip 12 comprises a main body 1201 and two metal mounting parts 1202, the two metal mounting parts 1202 are respectively arranged at both ends of the main body 1201, and the two metal mounting parts 1202 are both provided with bayonets 12021. The metal mounting part 1202 located at one end of the main body 1201 passes through a non-rigid gap locking piece 13 to be fastened into a slot 1102 on an inner side plate 1101; specifically, the bayonet 12021 of the metal mounting part 1202 located at one end of the main body 1201 snaps into an inner side plate 1101, and the top wall of the bayonet 12021 abuts against the bottom wall of the slot 1102, so that an inner side plate 1101 can bear one end of the bed board strip 12. The metal mounting part 1202 located at the other end of the main body 1201 passes through another non-rigid gap locking piece 13 to be fastened into the corresponding slot 1102 on the opposite other inner side plate 1101; specifically, the bayonet 12021 of the metal mounting part 1202 located at the other end of the main body 1201 snaps into the other inner side plate 1101, and the top wall of the bayonet 12021 abuts against the bottom wall of the slot 1102 on the other inner side plate 1101 so that the other inner side plate 1101 can bear the other end of the bed board strip 12. Under the gravity of the bed board strip 12 itself, the inner side plate 1101 of the metal bracket 11 and the bayonet 12021 are kept in a clamped state, so that the metal mounting part 1202 can be prevented from leaving the slot 1102 without manual intervention, and the reliability of installation between the bed board strip 12 and the metal bracket 11 is ensured.

It shall be noted that, in this embodiment, the installation mode for the metal mounting parts 1202 of all the bed board strips 12 and the inner side plates 1101 is the same, and the metal mounting parts 1202 are all installed on the inner side plates 1101 through the non-rigid gap locking pieces 13; the present application will only describe the installation mode for one of the metal mounting parts 1202 and the inner side plate 1101 in detail, and installation mode for other metal mounting parts 1202 and the inner side plates 1101 shall be conceived by the reader, and thus the installation mode for other metal mounting parts 1202 and the inner side plates 1101 will not be further described herein.

For the above-mentioned non-rigid gap locking piece 13, the non-rigid gap locking piece 13 comprises a limit plate 1301 and a first buckle 1302, the first buckle 1302 is obtained by extending from the inner surface of the limit plate 1301, and the inner surface of the limit plate 1301 is the surface of the limit plate 1301 facing the inner side plate 1101. The limit plate 1301 is further provided with a limit notch 13011, which is obtained by extending inward from one edge of the limit plate 1301. The metal mounting part 1202 passes through the limit notch 13011, so that the non-rigid gap locking piece 13 rides on the bed board strip 12, the metal mounting part 1202 passes through the slot 1102, the bayonet 12021 is clamped on the inner side plate 1101, and the first buckle 1302 passes through the slot 1102 to be clamped on the inner surface of the metal bracket 11.

The width of the metal mounting part 1202 is the same as that of the limit notch 13011, so that when the metal mounting part 1202 is clamped into the limit notch 13011, two side walls of the metal mounting part 1202 respectively abut against two inner side walls of the limit notch 13011 so as to restrict the metal mounting part 1202 from swinging left and right.

The sum of the distance from the inner top wall of the limit notch 13011 to the other edge of the limit plate 1301 and the distance from the inner top wall of the bayonet 12021 to one side of the metal mounting part 1202 far away from the bayonet 12021 is equal to the height of the slot 1102, so that when the bayonet 12021 is clamped on the inner side plate 1101 and the first buckle 1302 passes through the slot 1102 to be clamped on the inner surface of the metal bracket 11, the inner top wall of the limit notch 13011 abuts against the top wall of the metal mounting part 1202 to restrict the metal mounting part 1202 from swinging up and down.

In some embodiments, the height of the first buckle 1302 is the same as the height of the slot 1102 along the direction perpendicular to the direction in which the bayonet 12021 is clamped on the inner side plate, so that when the first buckle 1302 is clamped on the inner surface of the metal bracket 11, the bottom and top of the first buckle 1302 respectively abut against the inner bottom wall and the inner top wall of the slot 1102, thereby restricting the movement of the first buckle 1302 in the direction perpendicular to the direction in which the bayonet 12021 is clamped on the inner side plate so that the first buckle is clamped more stably. In addition, the height of the metal mounting part 1202 is the same as that of the slot 1102 along the direction perpendicular to the direction in which the bayonet 12021 is clamped on the inner side plate 1101, so that the metal mounting part 1202 can be just inserted into the slot 1102 to prevent the slot 1102 from being opened too large.

In some embodiments, the number of the first buckles 1302 is two, the two first buckles 1302 are respectively located at two sides of the limit notch 13011, the two first buckles 1302 further respectively abut against two sides of the slot 1102 of the metal bracket 11, and the two first buckles 1302 are clamped on the inner surface of the metal bracket 11, so that the non-rigid gap locking piece 13 can be clamped more stably. In addition, a first buckle 1302 is located between a side wall of the metal mounting part 1202 and an inner side wall of the slot 1102, and the other first buckle 1302 is located in the gap between another side wall of the metal mounting part 1202 and another inner side wall of the slot 1102; the two first buckles 1302 also play the role of isolating the metal mounting part 1202 from the two inner side walls of the slot 1102 to prevent the contact between the two side walls of the metal mounting part 1202 and the two inner side walls of the slot 1102 when the non-rigid gap locking piece 13 swings horizontally, thereby further reducing the risk of generating noise due to the friction or collision between the metal mounting part 1202 and the inner side plate 1101 of the metal bracket 11.

In some embodiments, the distance between the surface of a first buckle 1302 facing away from the other first buckle 1302 and the surface of the other first buckle 1302 facing away from the first buckle 1302 is the same as the width of the slot 1102, so that when the two first buckles 1302 pass through the slot 1102, the two inner side walls of the slot 1102 respectively abut against the two first buckles 1302 so as to restrict the non-rigid gap locking piece 13 from swinging left and right. Meanwhile, the distance from the hook of the first buckle 1302 to the limit plate 1301 is equal to the thickness of the inner side plate 1101, so as to restrict the first buckle 1302 from swinging back and forth when the first buckle 1302 is clamped on the inner side plate 1101, thereby reducing the probability of back and forth swing of the non-rigid gap locking piece 13.

It is worth noting that: the non-rigid gap locking piece 13 is made of plastic or silica gel material, and thus, even if there is slight friction between the bed board strip 12 and the non-rigid gap locking piece 13, the noise generated is far less than that generated by the friction between metals; in other words, the noise generated between the metal bracket 11 and the bed board strip 12 can be greatly reduced by the non-rigid gap locking piece 13. In addition, the non-rigid gap locking piece 13 is made of plastic or rubber material, so that the first buckle 1302 of the non-rigid gap locking piece 13 has certain flexibility, and it is easier for the first buckle 1302 to be clamped and disassembled.

In some embodiments, the metal bracket 11 is a hollow metal tube structure, and the adoption of metal material can not only ensure that the metal bracket 11 has sufficient hardness, but also reduce the weight of the metal bracket 11 and save raw materials, thus being beneficial for reducing the cost.

In some embodiments, the metal bracket 11 may also be a metal material with an L-shaped cross section or a metal material with a U-shaped cross section.

In some embodiments, the main body 1201 and the metal mounting part 1202 of the bed board strip 12 are a metal tube structure integrally formed, and the metal mounting part 1202 is a flat structure formed at the end of the bed board strip 12.

In some embodiments, the main body 1201 of the bed board strip 12 is a wooden strip or a wooden stick, the metal mounting part 1202 is a metal structural member that is sleeved or embedded at the end of the wooden strip or the wooden stick, and the metal mounting part 1202 has a flat structure.

It shall be appreciated that: in some embodiments, the bed frame 100 comprises a plurality of bed frame modules 1, one metal bracket 11 in each of the bed frame modules 1 is connected end to end in turn, and the other metal bracket 11 in each of the bed frame modules 1 is also connected end to end in turn, and one end of two metal brackets 11 in the bed frame module 1 at the beginning is installed on both sides of the bed head support frame 2 respectively, and one end of two metal brackets 11 in the bed frame module 1 at the ending is installed on both sides of the bed tail support frame 3 respectively. By arranging the plurality of bed frame modules 1, the bearing space of the bed frame 100 is greatly increased.

In this embodiment, the metal bracket 11 is provided with the plurality of slots 1102 which are distributed at intervals, the first buckle 1302 extends from the limit plate 1301, and the limit notch 13011 is arranged at the limit plate 1301, so that the first buckle 1302 is clamped on the inner surface of the metal bracket 11 from the slot 1102, and the two inner side walls of the limit notch 13011 respectively abut against the two side walls of the metal mounting part 1202, thereby avoiding the contact between the two side walls of the metal mounting part 1202 and the two inner side walls of the slot 1102; and this is beneficial for reducing the collision or friction between the metal bracket 11 and the bed board strip 12 caused by the swing of the bed frame 100 so as to reduce the noise generated by the bed frame 100.

The present application further provides a method for installing the bed frame 100 applied in the first embodiment, and the method comprises the following steps:

- step A1: inserting the metal mounting part 1202 into the inner side plate 1101 and moving the metal mounting part 1202 downwards along the bayonet 12021 to realize interlocking and fastening with the inner side plate 1101;
- step A2: riding the limit notch 13011 of the limit plate 1301 on the top wall of the metal mounting part 1202;
- step A3: passing the first buckle 1302 through the slot 1102 to be clamped with an inner surface of the metal bracket 11, so that two inner side walls of the limit notch 13011 respectively abut against two side walls of the metal mounting part 1202, so as to prevent the two side walls of the metal mounting part 1202 from contacting with two inner side walls of the slot 1102.

First, the metal mounting part 1202 is fastened to the inner side plate 1101 through the bayonet 12021, then the non-rigid gap locking piece 13 is clamped on the inner side plate 1101 from the slot 1102, and the displacement of the metal mounting part 1202 is limited by the non-rigid gap locking piece 13, so that the contact between the metal mounting part 1202 and the inner side plate 1101 is avoided, which is beneficial for reducing the noise generated when the bed frame 100 swings and improving the user experience.

Second Embodiment

Except for the non-rigid gap locking piece 13, other parts of the bed frame of this embodiment are the same as those of other embodiments, and the structures of other parts except for the non-rigid gap locking piece are not further described in detail in this embodiment, and this embodiment focuses on the description of the non-rigid gap locking piece 13, specifically:

- referring to FIG. 6, FIG. 7, FIG. 8 and FIG. 9, the non-rigid gap locking piece 13 comprises an upper limit plate 1303, a first deformation plate 1304 and a lower limit plate 1305, both ends of the first deformation plate 1304 are connected with the upper limit plate 1303 and the lower limit plate 1305 respectively.

For the upper limit plate 1303 described above, a first buckle 1306 is formed by extending from the inner surface of the upper limit plate 1303, and the inner surface of the upper limit plate 1303 is the surface of the upper limit plate 1303 facing the inner side plate 1101. The first buckle 1306 passes through the slot 1102 to be clamped with the inner surface of the metal bracket 11, so that the upper limit plate 1303 is fixed with the metal bracket 11.

In some embodiments, the number of the first buckles 1306 is two, the two first buckles 1306 are respectively located at two sides of the limit opening 13041, and the two first buckles 1306 are respectively clamped on two sides of the slot 1102 of the metal bracket 11. The distance between the two first buckles 1306 is the same as the width of the slot 1102, so that when the two first buckles 1306 pass through the slot 1102, the two inner side walls of the slot 1102 respectively abut against the two first buckles to restrict the non-rigid gap locking piece 13 from swinging left and right. Meanwhile, the distance from the hook of the first buckle 1306 to the upper limit plate 1303 is equal to the thickness of the inner side plate 1101, so as to restrict the first buckle 1306 from swinging back and forth when the first buckle 1306 is clamped on the inner side plate 1101, thereby reducing the probability of back and forth swing of the non-rigid gap locking piece 13.

For the lower limit plate 1305 and the first deformation plate 1304 described above, both ends of the first deformation plate 1304 are respectively connected with the upper limit plate 1303 and the lower limit plate 1305. A second buckle 1307 is formed by extending from the inner surface of the lower limit plate 1305, the second buckle 1307 passes through the slot 1102 to be clamped with the inner surface of the metal bracket 11, and the second buckle 1307 abuts against the inner bottom wall of the slot 1102 so that the lower limit plate 1305 is fixed with the metal bracket 11. The first deformation plate 1304 is provided with a limit opening 13041, and after the metal mounting part 1202 passes through the limit opening 13041 and the slot 1102, the bayonet 12021 is clamped on the second buckle 1307, the inner side plate 1101 and the lower limit plate 1305.

The width of the metal mounting part 1202 is the same as the width of the limit opening 13041, so that when the metal mounting part 1202 passes through the limit opening 13041, the two side walls of the metal mounting part 1202 further abut against the two inner side walls of the limit opening 13041 respectively, so as to restrict the metal mounting part 1202 from swinging left and right.

When the first buckle 1306 and the second buckle 1307 are clamped on the inner surface of the metal bracket 11, the first deformation plate 1304 is deformed, and the first deformation plate 1304 provides push force in opposite directions to the upper limit plate 1303 and the lower limit plate 1305, the top of the first buckle 1306 abuts against the inner top wall of the slot 1102, the second buckle 1307 abuts against the inner bottom wall of the slot 1102, and the inner top wall of the limit opening 13041 abuts against the top wall of the metal mounting part 1202, and the inner top wall of the bayonet 12021 of the metal mounting part 1202 abuts against the inner bottom wall of the slot 1102, so that the metal mounting part 1202 remains clamped with the second buckle 1307 to prevent the metal mounting part 1202 from swinging up and down.

It is worth noting that: the distance between the two inner side walls of the limit opening 13041 is smaller than the distance between the two inner side walls of the slot 1102; that is, the two inner side walls of the limit opening 13041 are located between the two inner side walls of the slot 1102, and the two side walls of the metal mounting part 1202 will not contact with the two inner side walls of the slot 1102, thereby reducing the risk of generating noise due to the friction or collision between the metal mounting part 1202 and the inner side plate 1101 of the metal bracket 11.

In some embodiments, the second buckle 1307 is located on the central axis of the two first buckles 1306 when it is observed in the direction in which the bayonet 12021 is clamped on the inner side plate 1101, and this is beneficial for improving the clamping stability of the non-rigid gap locking piece 13.

In some embodiments, the second buckle 1307 is formed with a first limit groove 13071 which accommodates the metal mounting part 1202, and the bottom surface 13072 of the first limit groove 13071, the inner side plate 1101 and the lower limit plate 1305 are all clamped in the bayonet 12021. The distance from the bottom surface of the first limit groove 13071 to the outer surface of the lower limit plate 1305 is equal to the width of the bayonet 12021, so that one inner side wall of the bayonet 12021 faces and abuts against the bottom surface 13072 of the first limit groove 13071, and another inner side wall of the bayonet 3021 faces and abuts against the lower limit plate 1305, thereby limiting the back and forth swing of the bed board strip 12 relative to the metal bracket 11.

In some embodiments, the distance from the hook of the second buckle 1307 to the lower limit plate 1305 is equal to the thickness of the inner side plate 1101, so as to restrict the second buckle 1307 from swinging back and forth when the second buckle 1307 is clamped on the inner side plate 1101, thereby reducing the probability of back and forth swing of the non-rigid gap locking piece 13 and making the clamping of the second buckle 1307 more stable.

Bending marks 1308 are formed respectively at joints between the first deformation plate 1304 and the upper limit plate 1303 as well as between the first deformation plate 1304 and the lower limit plate 1305, and at least one bending mark 1308 is formed at the middle of the first deformation plate 1304, so that the first deformation plate 1304 can be bent in the second direction Y which is perpendicular to the top wall 12022 of the metal mounting part 1202.

Figure 8:
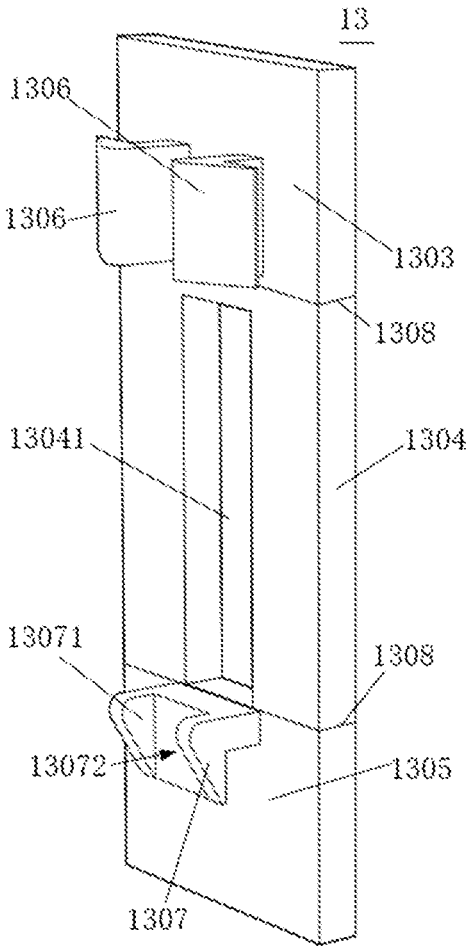
FIG. 8 is a schematic structural diagram of a non-rigid gap locking piece when a first deformation plate in the second embodiment of the present application is in the extended state.
Figure 9:
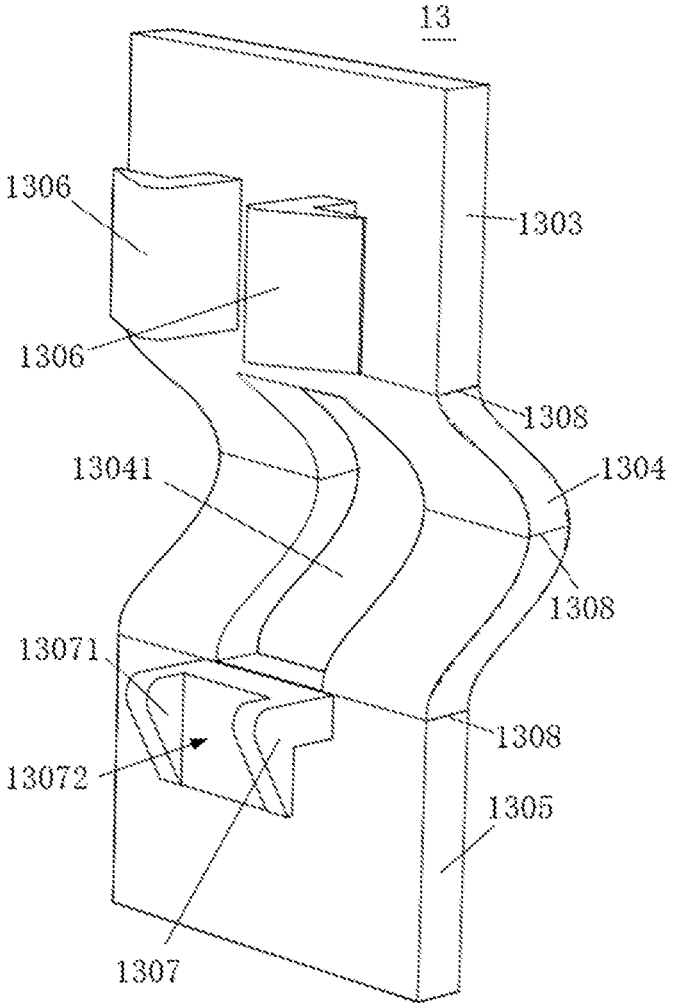
FIG. 9 is a schematic structural diagram of the non-rigid gap locking piece when the first deformation plate in the second embodiment of the present application is in the bent state.
Figure 10:
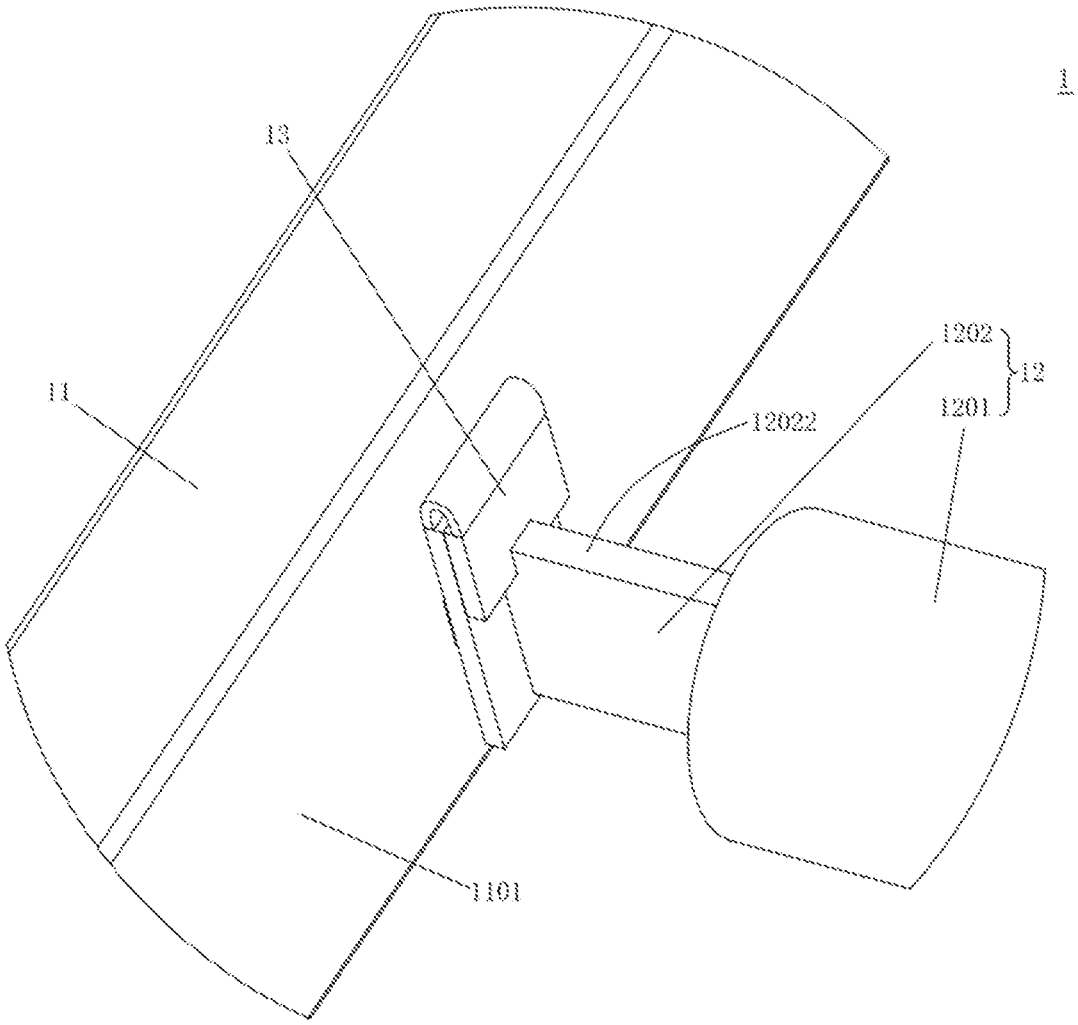
FIG. 10 is a schematic view of a partial structure of a bed frame module in a third embodiment of the present application.
Figure 11:
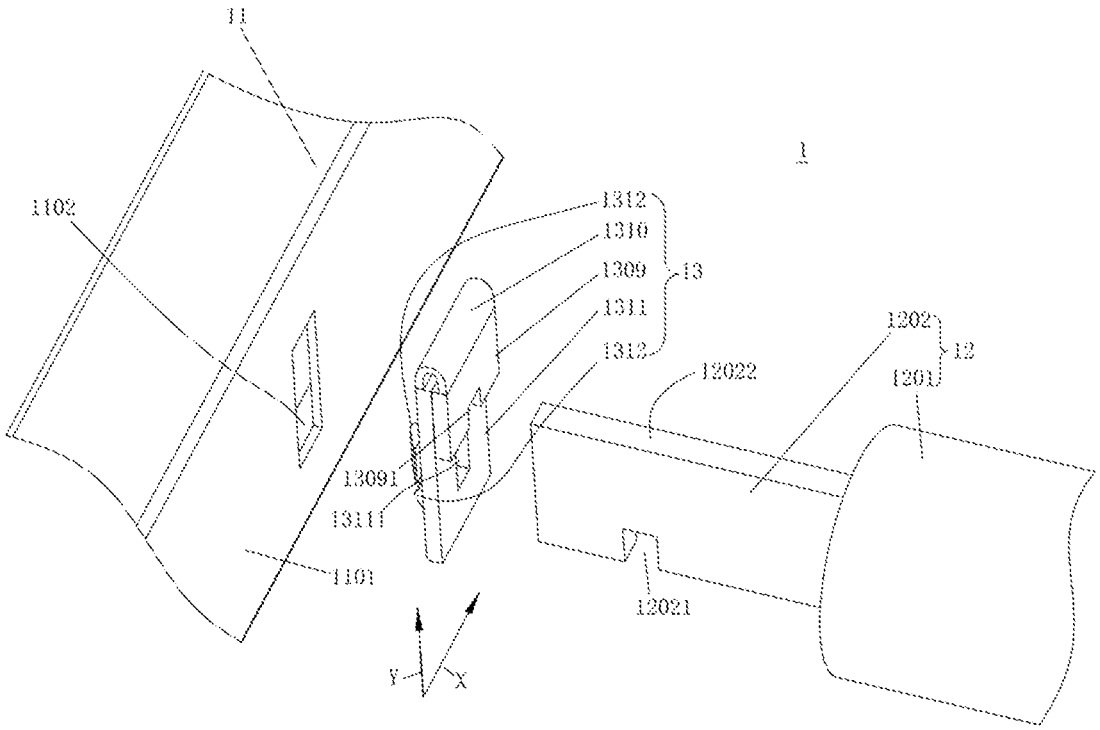
FIG. 11 is a schematic view of the exploded state of the partial structure of the bed frame module in the third embodiment of the present application.
Figure 12:
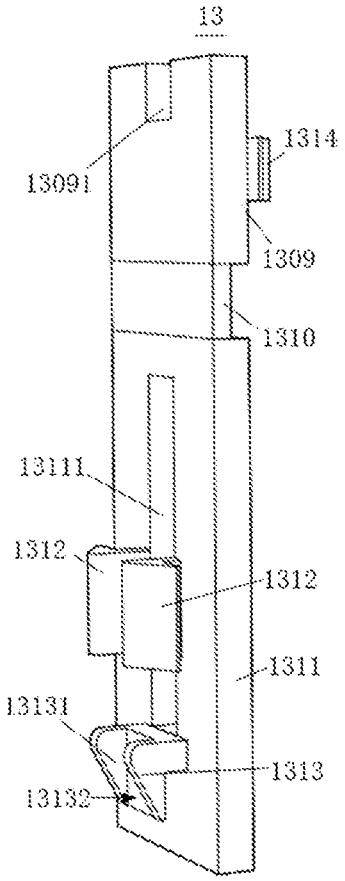
FIG. 12 is a schematic structural diagram of a non-rigid gap locking piece when a bending part in the third embodiment of the present application is in the extended state.
Figure 13:
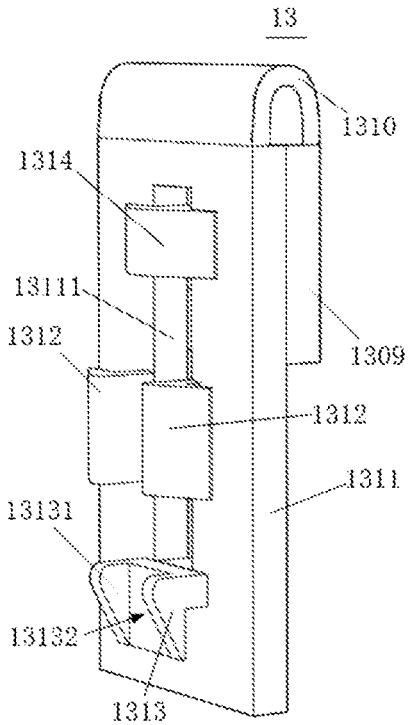
FIG. 13 is a schematic structural diagram of the non-rigid gap locking piece when the bending part in the third embodiment of the present application is in the bent state.

When the first deformation plate 1304 is in the extended state shown in FIG. 8, the minimum distance between the upper limit plate 1303 and the lower limit plate 1305 is greater than the distance between the upper and lower side walls of the slot 1102. Therefore, when installing the non-rigid gap locking piece 13 on the metal bracket 11, the second buckle 1307 may first pass through the slot 1102 to be clamped on the inner surface of the metal bracket 11, and then the metal mounting part 1202 passes through the limit opening 13041 and the slot 1102 in turn to be clamped on the inner side plate 1101, and then the first deformation plate 1304 is compressed into a bent state, and finally the two first buckles 1306 respectively pass through the gap between the metal mounting parts 1201 and the two inner side walls of the slot 1102 to be clamped on the inner surface of the metal frame 11. Under the joint restriction of the inner bottom wall of the slot 1102 and the inner top wall of the slot 1102, the first deformation plate 1304 keeps being bent so that the top of the first buckle 1306 keeps abutting against the inner top wall of the slot 1102, and at this time, the top wall 12022 of the metal mounting part 1202 abuts against the inner top wall of the limit opening 13041, thereby limiting the displacement of the metal mounting part 1202 in the direction Y, and effectively reducing the risk of contact between the metal mounting part 1202 and the inner top wall of the slot 1102.

It is worth noting that the non-rigid gap locking piece 13 is made of plastic or rubber material, so that the first buckle 1306 of the non-rigid gap locking piece 13 has certain flexibility, and thus, the first buckle 1306 can easily pass through the gap between the metal mounting part 1202 and the inner side wall of the slot 1102.

In some embodiments, the metal bracket 11 is a hollow metal tube structure, and the adoption of metal material can not only ensure that the metal bracket 11 has sufficient hardness, but also reduce the weight of the metal bracket 11 and save raw materials, thus being beneficial for reducing the cost.

In some other embodiments, the metal bracket 11 may also be a metal material with an L-shaped cross section or a metal material with a U-shaped cross section.

In some embodiments, the main body 1201 and the metal mounting part 1202 of the bed board strip 12 are a metal tube structure integrally formed, and the metal mounting part 1202 is a flat structure formed at the end of the bed board strip 12.

In some other embodiments, the main body 1201 of the bed board strip 12 is a wooden strip or a wooden stick, the metal mounting part 1202 is a metal structural member that is sleeved or embedded at the end of the wooden strip or the wooden stick, and the metal mounting part 1202 has a flat structure.

In this embodiment, through the bending of the first deformation plate 1304, the first buckle 1306 is kept abutting against the inner top wall of the slot 1102, the second buckle 1307 is kept abutting against the inner bottom wall of the slot 1102, and the top wall of the metal mounting part 1202 abuts against the inner top wall of the limit opening 13041, so that the displacement of the metal mounting part 1202 in the direction Y is limited; then, the two inner side walls of the limit opening 13041 respectively abut against the two side walls of the metal mounting part 1202, so that the displacement of the metal mounting part 1202 in the X direction is limited, and the risk of generating noise due to the collision or friction between the metal mounting part 1202 and the inner side plate 1101 is reduced.

The present application further provides a method for installing the bed frame 100 applied in the second embodiment, and the method comprises the following steps:

step B1: operating the lower limit plate 1305, and passing the second buckle 306 through the slot 1102 to be clamped with the inner surface of the metal bracket 11 and abut against the inner bottom wall of the slot 1102;

step B2: inserting the metal mounting part 1202 into the inner side plate 1101 through the limit opening 13041 and the slot 1102 in turn, and moving the metal mounting part 1202 downwards along the bayonet 12021 to realize interlocking and fastening with the inner side plate 1101;

step B3: pressing the upper limit plate 1303 downwards so that the first deformation plate 1304 is in a bent and deformed state, and passing the first buckle 1306 through the slot 1102 to be clamped with the inner surface of the metal bracket 11, so that the two inner side walls of the limit opening 13041 respectively abut against two side walls of the metal mounting part 1202, and an inner bottom wall of the limit opening 13041 abuts against an inner top wall of the bayonet 12021 of the metal mounting part 1202, so as to prevent the bottom of the metal mounting part 1202 from contacting with the inner bottom wall of the slot 1102, and prevent the two side walls of the metal mounting part 1202 from contacting with two inner side walls of the slot 1102 respectively.

First, the second buckle 306 is clamped on the inner surface of the metal bracket 11, then the metal mounting part 1202 passes through the limit opening 13041 and the slot 1102, and then the first deformation plate 1304 is bent to clamp the first buckle 1306 on the inner surface of the metal bracket 11 so that the two inner side walls of the limit opening 13041 respectively abut against the two side walls of the metal mounting part 1202 and the inner bottom wall of the limit opening 13041 abuts against the inner top wall of the bayonet 12021 of the metal mounting part 1202, thereby limiting the displacement of the metal mounting part 1202, and avoiding the contact between the metal mounting part 1202 and the inner side plate 1101; and this is beneficial for reducing the noise generated when the bed frame 100 swings and improving the user experience.

Third Embodiment

Except for the non-rigid gap locking piece 13, other parts of the bed frame of this embodiment are the same as those of other embodiments, and the structures of other parts except for the non-rigid gap locking piece are not further described in detail in this embodiment, and this embodiment focuses on the description of the non-rigid gap locking piece 13, specifically:

referring to FIG. 10, FIG. 11, FIG. 12 and FIG. 13, the non-rigid gap locking piece 13 comprises an upper limit plate 1309, a bending part 1310 and a lower limit plate 1311, and both ends of the bending part 1310 are respectively connected with the lower limit plate 1311 and the upper limit plate 1309. The lower limit plate 1311 is provided with an opening 13111, and a second buckle 1313 is formed by extending from the inner surface of the lower limit plate 1311, the second buckle 1313 passes through the slot 1102 to be clamped with the inner surface of the metal bracket 11, and the second buckle 1313 abuts against the inner bottom wall of the slot 1102. The bending part 1310 is bent to allow the upper limit plate 1309 to rotate to a position where the upper limit plate 1309 and the lower limit plate 1311 overlap. An edge of the upper limit plate 1309 far away from the bending part 1310 is provided with a limit notch 13091, and a third buckle 1314 is formed by extending from the outer surface of the upper limit plate 1309; when the upper limit plate 1309 rotates to a position overlapping with the lower limit plate 1311, the third buckle 1314 passes through the opening 13111 and the slot 1102 in turn to be clamped on the inner surface of the metal bracket 11. The two inner side walls of the opening 13111 are located between the two inner side walls of the slot 1102, and after the displacement of the metal mounting part 1202 is limited by the opening 13111, there is an interval between the metal mounting part 1202 and the two inner side walls of the slot 1102, so that the contact and friction between the metal mounting part 1202 and the two inner side walls of the slot 1102 can be avoided to avoid the generation of noise.

In some embodiments, when the third buckle 1314 passes through the opening 13111 and the slot 1102 in turn to be clamped on the inner surface of the metal bracket 11, the inner top wall of the limit notch 13091 abuts against the top wall of the metal mounting part 1202, and the inner top wall of the bayonet 12021 abuts against the inner bottom wall of the opening 13111 and the second buckle 1313, thereby limiting the up and down displacement of the metal mounting part 1202 and preventing the metal mounting part 1202 from swinging up and down.

In some embodiments, the number of the third buckles 1314 is two, and the two third buckles 1314 respectively abut against two sides of the opening 13111 of the lower limit plate 1311, wherein the distance between the two third buckles 1314 is the same as the distance of the opening 13111, so that when the two third buckles 1314 are clamped on both sides of the opening 13111, the third buckles 1314 is restricted from swinging left and right, thereby limiting the left and right swing of the upper limit plate 1309 and making the fixation of the upper limit plate 1309 more stable.

Meanwhile, the width of the limit notch 13091 is the same as the width of the metal mounting part 1202, and the width of the opening 13111 is also the same as the width of the metal mounting part 1202; when the metal mounting part 1202 passes through the limit notch 13091 and the opening 13111, two side walls of the metal mounting part 1202 respectively abut against two inner side walls of the opening 13111 and two inner walls of the limit notch 13091.

In some embodiments, the second buckle 1313 is formed with a first limit groove 13131, which accommodates the metal mounting part 1202, and the bottom surface of the first limit groove 13131, the inner side plate 1101 and the lower limit plate 1311 are all clamped in the bayonet 12021. The distance from the bottom surface of the first limit groove 13131 to the outer surface of the lower limit plate 1311 is equal to the width of the bayonet 12021, so that one inner side wall of the bayonet 12021 faces and abuts against the bottom surface 13132 of the first limit groove 13131, and another inner side wall of the bayonet 3021 faces and abuts against the lower limit plate 1305, thereby limiting the back and forth movement of the bed board strip 12 relative to the metal bracket 11. In addition, the width of the first limit groove 13131 is the same as the width of the metal mounting part 1202, the two side walls of the metal mounting part 1202 abut against the two inner side walls of the first limit groove 13131 respectively, and the first limit groove 13131 also restricts the metal mounting part 1202 from swinging left and right.

Optionally, the bending part 1310 is a bending mark to allow the upper limit plate 1309 to rotate relative to the lower limit plate 1311 to a position where the upper limit plate 1309 and the lower limit plate 1311 overlap.

In some embodiments, a first buckle 1312 is formed by extending from the inner surface of the lower limit plate 1311, and the first buckle 1312 passes through the slot 1102 to be clamped with the inner surface of the metal bracket 11.

Further speaking, the number of the first buckles 1312 is two, the two first buckles 1312 are located at two sides of the opening 13111 respectively, the two first buckles 1312 respectively pass through the gap between the metal mounting part 1202 and the two inner side walls of the solt 1102 to be clamped with the inner surface of the metal bracket 11.

It is worth noting that: the non-rigid gap locking piece 13 is made of plastic or silica gel material, and thus, even if there is slight friction between the bed board strip 12 and the non-rigid gap locking piece 13, the noise generated is far less than that generated by the friction between metals; in other words, the noise generated between the metal bracket 11 and the bed board strip 12 can be greatly reduced by the non-rigid gap locking piece 13.

In some embodiments, the metal bracket 11 is a hollow metal tube structure, and the adoption of metal material can not only ensure that the metal bracket 11 has sufficient hardness, but also reduce the weight of the metal bracket 11 and save raw materials, thus being beneficial for reducing the cost.

In some other embodiments, the metal bracket 11 may also be a metal material with an L-shaped cross section or a metal material with a U-shaped cross section.

In some embodiments, the main body 1201 and the metal mounting part 1202 of the bed board strip 12 are a metal tube structure integrally formed, and the metal mounting part 1202 is a flat structure formed at the end of the bed board strip 12.

In some other embodiments, the main body 1201 of the bed board strip 12 is a wooden strip or a wooden stick, the metal mounting part 1202 is a metal structural member that is sleeved or embedded at the end of the wooden strip or the wooden stick, and the metal mounting part 1202 has a flat structure.

In this embodiment, the bending part 1310 is bent to the position where the lower limit plate 1311 and the upper limit plate 1309 overlap, so that the third buckle 1314 passes through the opening 13111 and the slot 1102 to be clamped on the inner surface of the metal bracket 11, and the inner top wall of the limit notch 13091 abuts against the top wall 12022 of the metal mounting part 1202, both the inner bottom wall of the opening 13111 and the second buckle 1313 abut against the inner top wall of the bayonet 12021, thereby limiting the displacement of the metal mounting part 1202 in the Y direction and preventing the metal mounting part 1202 from contacting with the inner bottom wall of the slot 1102 and the inner top wall of the slot 1102; then, the two inner side walls of the opening 13111 respectively abut against the two side walls of the metal mounting part 1202, so that the displacement of the metal mounting part 1202 in the X direction is limited, and the metal mounting part 1202 is prevented from contacting with the two inner side walls of the slot 1102, thereby reducing the risk of generating noise due to the collision or friction between the metal mounting part 1202 and the inner side plate 1101.

The present application further provides a method for installing the bed frame 100 applied in the third embodiment, and the method comprises the following steps:

step C1: operating the lower limit plate 1311, and passing the second buckle 1313 through the slot 1102 to be clamped with the inner surface of the metal bracket 11 and abut against the inner bottom wall of the slot 1102;

step C2: inserting the metal mounting part 1202 into the inner side plate 1101 through the opening 13111 and the slot 1102 in turn, and moving the metal mounting part 1202 downwards along the bayonet 12021 to realize interlocking and fastening with the inner side plate 1101, so that two inner side walls of the opening 13111 respectively abut against two side walls of the metal mounting part 1202, and the inner bottom wall of the opening 131111 abuts against the inner top wall of the bayonet 12021 of the metal mounting part 1202, so as to prevent the bottom of the metal mounting part 1202 from contacting with the inner bottom wall of the slot 1102, and prevent the two side walls of the metal mounting part 1202 from contacting with two inner side walls of the slot 1102 respectively;

step C3: rotating the upper limit plate 1309, and passing the third buckle 313 through the opening 13111 and the slot 1102 in turn to be clamped with the inner surface of the metal bracket 11, so that the inner top wall of the limit notch 13091 abuts against the top wall of the metal mounting part 1202.

First, the second buckle 1313 is clamped on the inner surface of the metal bracket 11, then the metal mounting part 1202 passes through the opening 13111 and the slot 1102, and then the upper limit plate 1309 is rotated so that the third buckle 313 passes through the opening 13111 and the slot 1102 in turn to be clamped on the inner surface of the metal bracket 11, and the inner top wall of the limit notch 13091 abuts against the top wall of the metal mounting part 1202, the two inner side walls of the opening 13111 respectively abut against the two side walls of the metal mounting part 1202, thereby limiting the displacement of the metal mounting part 1202, and avoiding the contact between the metal mounting part 1202 and the inner side plate 1101; and this is beneficial for reducing the noise generated when the bed frame 100 swings and improving the user experience.

It shall be noted that, the specification and the attached drawings of the present application provide preferred embodiments of the present application, but the present application may be realized in many different forms and is not limited to the embodiments described in this specification; these embodiments are not used as additional restrictions on the contents of the present application, and the purpose of providing these embodiments is to make the disclosure of the present application more thorough and comprehensive. Moreover, the above technical features continue to be combined with each other to form various embodiments not listed above, and all these embodiments are regarded as within the scope recorded in the specification of the present application; furthermore, improvements or changes can be made by those of ordinary skill in the art according to the above description, and all these improvements and changes shall belong to the scope claimed in the appended claims of the present application.

What is claimed is:

1. A bed frame, characterized in that the bed frame comprises one or more bed frame modules, each of the bed frame modules comprising:

two metal brackets longitudinally arranged, each of the metal brackets being provided with inner side plates arranged oppositely, each of the inner side plates being provided with a plurality of slots at intervals;

a plurality of bed board strips, each of the bed board strips comprising a main body and metal mounting parts at two ends of the main body, the metal mounting parts being provided with bayonets; wherein the metal mounting parts are fastened into the slots; the bayonet snaps into one inner side plate, and the top wall of the bayonet abuts against the bottom wall of the slot; and a non-rigid gap locking piece, comprising a limit plate and a first buckle obtained by extending from an inner surface of the limit plate, the limit plate being provided with a limit notch; wherein the first buckle passes through the slot to be clamped with an inner surface of the metal bracket, two inner side walls of the limit notch respectively abut against two side walls of the metal mounting part to prevent the two side walls of the metal mounting part from contacting with two inner side walls of the slot.

2. The bed frame according to claim 1, being characterized in that, an inner top wall of the limit notch abuts against a top wall of the metal mounting part.

3. The bed frame according to claim 2, being characterized in that, the top of the first buckle abuts against an inner top wall of the slot to restrict the movement of the metal mounting part along the direction of the slot.

4. The bed frame according to claim 1, being characterized in that, the metal bracket is a hollow metal tube structure.

5. The bed frame according to claim 1, being characterized in that, the main body and the metal mounting part of the bed board strip are an integrally formed metal tube structure, and the metal mounting part is a flat structure formed at the end of the bed board strip.

6. A bed frame, characterized in that the bed frame comprises one or more bed frame modules, each of the bed frame modules comprising:

two metal brackets longitudinally arranged, each of the metal brackets being provided with inner side plates arranged oppositely, each of the inner side plates being provided with a plurality of slots at intervals;

a non-rigid gap locking piece, comprising an upper limit plate, a lower limit plate and a first deformation plate, wherein a first buckle is formed by extending from an inner surface of the upper limit plate, the first buckle passes through the slot to be clamped with an inner surface of the metal bracket, a second buckle is formed by extending from an inner surface of the lower limit plate, the second buckle passes through the slot to be clamped with the inner surface of the metal bracket and abut against an inner bottom wall of the slot, the first deformation plate is arranged between the upper limit plate and the lower limit plate, the first deformation plate is provided with a limit opening; wherein when both the upper limit plate and the lower limit plate are clamped with the metal bracket, the first deformation plate is in a bent and deformed state;

a plurality of bed board strips, each of the bed board strips comprising a main body and metal mounting parts at two ends of the main body, the metal mounting parts being provided with bayonets; wherein the metal mounting part passes through the limit opening and the slot in turn and is detachably fastened on the inner side plate;

wherein two inner side walls of the limit opening respectively abut against two side walls of the metal mounting part, and an inner bottom wall of the limit opening abuts against an inner top wall of the bayonet of the metal mounting part to prevent the bottom of the metal mounting part from contacting with the inner bottom wall of the slot and prevent the two side walls of the metal mounting part from contacting with the inner bottom wall and two inner side walls of the slot respectively.

7. The bed frame according to claim 6, being characterized in that, an inner top wall of the limit opening abuts against a top wall of the metal mounting part.

8. The bed frame according to claim 7, being characterized in that, the top of the first buckle abuts against an inner top wall of the slot to restrict the movement of the metal mounting part along the direction of the slot.

9. The bed frame according to claim 6, being characterized in that, the second buckle is formed with a first limit groove, one inner side wall of the bayonet faces a bottom surface of the first limit groove, and another inner side wall of the bayonet faces the lower limit plate.

10. The bed frame according to claim 6, being characterized in that, bending marks are formed respectively at joints between the first deformation plate and the upper limit plate as well as between the first deformation plate and the lower limit plate, and at least one bending mark is formed at the middle of the first deformation plate.

11. A bed frame, characterized in that the bed frame comprises one or more bed frame modules, each of the bed frame modules comprising:

two metal brackets longitudinally arranged, each of the metal brackets being provided with inner side plates arranged oppositely, each of the inner side plates being provided with a plurality of slots at intervals;

a non-rigid gap locking piece, comprising an upper limit plate, a lower limit plate and a bending part formed between the upper limit plate and the lower limit plate; wherein the lower limit plate is provided with an opening, a second buckle is formed by extending from an inner surface of the lower limit plate, the second buckle passes through the slot to be clamped with an inner surface of the metal bracket and abut against an inner bottom wall of the slot; an edge of the upper limit plate furthest from the bending part is provided with a limit notch, and a third buckle is formed by extending from an outer surface of the upper limit plate, the third buckle passes through the opening and the slot in turn to be clamped on the inner surface of the metal bracket; and a plurality of bed board strips, each of the bed board strips comprising a main body and metal mounting parts at two ends of the main body, the metal mounting parts being provided with bayonets; wherein the metal mounting parts pass through the opening and the slot in turn and are detachably fastened on the inner side plate;

wherein two inner side walls of the opening respectively abut against two side walls of the metal mounting part, and an inner bottom wall of the opening abuts against an inner top wall of the bayonet of the metal mounting part, so as to prevent the bottom of the metal mounting part from contacting with the inner bottom wall of the slot, and prevent the two side walls of the metal mounting part from contacting with two inner side walls of the slot respectively.

12. The bed frame according to claim 11, being characterized in that, an inner top wall of the limit notch abuts against a top wall of the metal mounting part.

13. The bed frame according to claim 12, being characterized in that, a first buckle is formed by extending from the inner surface of the lower limit plate, and the top of the first buckle abuts against an inner top wall of the slot to restrict the movement of the metal mounting part along the direction of the slot.

14. The bed frame according to claim 11, being characterized in that, a first buckle is formed by extending from the inner surface of the lower limit plate, and the first buckle passes through the slot to be clamped with the inner surface of the metal bracket.

* * * * *